US007886993B2

(12) United States Patent
Bachmaier et al.

(10) Patent No.: US 7,886,993 B2
(45) Date of Patent: Feb. 15, 2011

(54) INJECTION VALVE

(75) Inventors: Georg Bachmaier, München (DE); Bernhard Fischer, Töging A. Inn (DE); Bernhard Gottlieb, München (DE); Andreas Kappel, Brunnthal (DE); Hans Meixner, Haar (DE); Enrico Ulivieri, München (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/924,007

(22) Filed: Aug. 23, 2004

(65) Prior Publication Data

US 2005/0017096 A1 Jan. 27, 2005

Related U.S. Application Data

(63) Continuation of application No. PCT/DE03/01062, filed on Apr. 1, 2003.

(30) Foreign Application Priority Data

Apr. 4, 2002 (DE) ..... 102 14 931

(51) Int. Cl.
*B05B 1/08* (2006.01)

(52) U.S. Cl. ..... 239/102.2; 239/533.7; 239/533.2; 239/102.1

(58) Field of Classification Search ..... 239/102.1, 239/102.2, 533.7, 584, 453, 125, 132.1, 132, 239/132.2, 129, 132.3, 126, 585.1
See application file for complete search history.

(56) References Cited

U.S. PATENT DOCUMENTS 2,614,888 A * 10/1952 Nichols ..... 239/126
4,579,283 A * 4/1986 Igashira et al. ..... 239/88
4,720,077 A * 1/1988 Minoura et al. ..... 251/129.06
4,725,002 A * 2/1988 Trachte ..... 239/102.2
4,784,102 A * 11/1988 Igashira et al. ..... 123/447
4,803,393 A * 2/1989 Takahashi ..... 310/328
5,875,764 A 3/1999 Kappel et al. ..... 123/467
6,010,592 A * 1/2000 Jameson et al. ..... 156/379.6
6,119,952 A * 9/2000 Kappel et al. ..... 239/5
6,196,472 B1 3/2001 Cooke ..... 239/88
6,260,776 B1 * 7/2001 Popp ..... 239/533.6
6,279,842 B1 * 8/2001 Spain ..... 239/585.1
6,311,950 B1 * 11/2001 Kappel et al. ..... 251/129.06
6,360,963 B2 * 3/2002 Popp ..... 239/132.5
6,400,066 B1 * 6/2002 Sumrak et al. ..... 310/346

(Continued)

FOREIGN PATENT DOCUMENTS

DE 4306072 2/1993

(Continued)

*Primary Examiner*—Len Tran
*Assistant Examiner*—Trevor E McGraw
(74) *Attorney, Agent, or Firm*—King & Spalding L.L.P.

(57) ABSTRACT

An injection valve for injecting fuel comprises a valve housing (1) inside of which a drive unit (15) controls the movement of a valve needle (5) that is pretensioned by a spring (11). The injection valve also comprises a main chamber (27), which is provided inside the valve housing, is filled with fuel and accommodates the valve needle (5), and comprises a hydraulic bearing for the drive unit (15). The hydraulic bearing has a hydraulic chamber (29) that is connected to the main chamber (27), whereby fuel serves as the operating substance of the hydraulic bearing.

19 Claims, 2 Drawing Sheets

U.S. PATENT DOCUMENTS

| | | | | |
|---|---|---|---|---|
| 6,425,532 | B1 * | 7/2002 | Popp | 239/132.5 |
| 6,450,417 | B1 * | 9/2002 | Gipson et al. | 239/5 |
| 6,464,149 | B1 | 10/2002 | Hardy et al. | 239/102.2 |
| 6,474,565 | B1 * | 11/2002 | Ruehle et al. | 239/102.1 |
| 6,499,448 | B2 * | 12/2002 | Yildirim et al. | 123/90.12 |
| 6,530,555 | B1 * | 3/2003 | Stoecklein et al. | 251/57 |
| 6,568,602 | B1 * | 5/2003 | Bram et al. | 239/5 |
| 6,575,138 | B2 * | 6/2003 | Welch et al. | 123/467 |
| 6,585,171 | B1 * | 7/2003 | Boecking | 239/102.1 |
| 6,637,677 | B1 | 10/2003 | Ruehle et al. | 239/584 |
| 6,739,575 | B2 * | 5/2004 | Cotton et al. | 251/129.06 |
| 6,807,950 | B2 * | 10/2004 | Boss et al. | 123/506 |
| 6,840,459 | B1 * | 1/2005 | Ruehle et al. | 239/102.2 |
| 6,932,278 | B2 * | 8/2005 | Reiter et al. | 239/102.2 |
| 6,953,158 | B2 * | 10/2005 | Liskow | 239/102.2 |
| 7,267,111 | B2 * | 9/2007 | Liskow | 123/498 |
| 2002/0139863 | A1 * | 10/2002 | Lorraine et al. | 239/5 |
| 2003/0127615 | A1 * | 7/2003 | Fischer et al. | 251/57 |
| 2004/0031862 | A1 * | 2/2004 | Eichendorf | 239/102.2 |

FOREIGN PATENT DOCUMENTS

| | | | |
|---|---|---|---|
| DE | 4306073 | | 2/1993 |
| DE | 19854508 | | 11/1998 |
| EP | 0477400 | | 4/1992 |
| EP | 0 872 636 | A2 | 4/1998 |
| EP | 0872636 | | 4/1998 |
| EP | 0937891 | | 2/1999 |
| EP | 1096137 | | 10/2000 |
| JP | 06267276 | | 9/1994 |
| JP | 10159673 | | 6/1998 |
| JP | 11141430 | | 5/1999 |
| JP | 2000356175 | | 12/2000 |
| WO | 00/17507 | | 3/2000 |
| WO | 02/31344 | | 4/2002 |
| WO | WO03018992 | * | 6/2003 |

* cited by examiner d5
25
33
1
31
17
d4
37
29
hK
42
35
d3
41
23
15
21
27
19
d2
13
11
5
3
9
d1
7

INJECTION VALVE

CROSS REFERENCE TO RELATED APPLICATION

This application is a continuation of copending International Application No. PCT/DE03/01062 filed Apr. 1, 2003 which designates the United States, and claims priority to German application no. 102 14 931.3 filed Apr. 4, 2002.

TECHNICAL FIELD OF THE INVENTION

The present invention relates to an injection valve.

DESCRIPTION OF THE RELATED ART

An injection valve of this kind is known from DE 198 54 508, the valve needle being designed to open outward, and the valve needle and housing having axially cooperating pressure surfaces implemented in such a way that, if the fluid pressure changes, the same axial variation in length occurs on the valve needle and on the valve housing. It is additionally possible to set the surfaces on the valve needle in such a way that the pressure of the fluid causes no force to be exerted on the return spring or valve seat, the drive chamber in which the drive unit is disposed and the fluid chamber in which the valve needle and return spring are disposed being securely sealed against one another by means of a seal ring and an outlet.

All the pressure forces are compensated in order to keep the valve needle free from pressure forces overall. For example, when fuel pressure is high, because of the pressure-loaded surface of the valve disk of an outward opening injector, a high pressure force acting in the direction of opening is exerted which is advantageously compensated by a second pressure-loaded surface which generates a counteracting pressure force of the same absolute value. With compensation of this kind, there are then no further limitations of any kind in respect of the valve disk diameter and the needle diameter.

Moreover, it is generally known that in the case of a high pressure injection valve (High Pressure Direct Injection, HPDI) for direct injection lean burn engines having a piezoelectric multilayer actuator as drive element, another operating medium in addition to the fuel is required for the hydraulic bearing in the injector, it being known that it is possible to automatically compensate all the thermal length variations as well as all the length variations caused by setting effects of the piezoelectric element or by pressure. In terms of material selection, this obviates the need for expensive alloys with low thermal expansion (e.g. Invar) and essentially means that cheaper steel with higher strength and easier machinability can be used. On the drive side, all the moving parts are held in contact with minimal force, so that no stroke losses due to gaps are produced. For an outward opening, piezoelectrically driven injector, hydraulic length compensation is implemented by an oil-filled hydraulic chamber. However, this necessitates expensive hermetic sealing of the operating medium, e.g. silicone oil, against the pressurized fuel, the seal frequently being implemented by a metal bellows.

SUMMARY OF THE INVENTION

The object of the present invention is to provide an efficient injection valve with a simple hydraulic bearing.

This object can be achieved by an injection valve for fuel comprising a valve housing in which a drive unit controls the movement of a valve needle pretensioned by a spring, a main chamber in the valve housing which is filled with fuel and in which the valve needle is disposed, and a hydraulic bearing for the drive unit, wherein the hydraulic bearing has a hydraulic chamber which is connected to the main chamber, and wherein the hydraulic chamber is filled with the fuel as operating medium of the hydraulic bearing.

The fuel can be used for cooling the drive unit. The drive unit can be disposed in the main chamber. The axially acting pressure surfaces of the valve needle can be dimensioned such that the resulting pressure forces essentially cancel each other out, causing the resulting axially acting force on the valve needle to be minimized compared to the force of the spring. A check valve can be installed in a high-pressure port of the injection valve. The valve needle can be fixed to the drive unit. The drive unit may have a hydraulic plunger which in conjunction with the inner wall section of the valve housing forms the hydraulic chamber. A height of the hydraulic chamber can be approximately 200 to 500 μm. The drive unit together with the hydraulic plunger and the valve needle may form a fixed unit which can be displaced virtually unimpeded relative to the injector housing in the event of slower movements occurring compared to the injection process, taking the spring forces into account. The drive unit can be connected to a hydraulic plunger which divides the inner chamber of the housing into the hydraulic chamber and the main chamber. The hydraulic chamber can be connected via a cross duct to a fuel supply duct entering the main chamber. Electrical leads of the drive unit can be brought out of an opening in the housing, and between the drive unit and the housing there can be provided a flexible means of sealing. The entire inner chamber of the valve housing between the means of sealing and an oppositely disposed valve seat can be filled with the fuel. The hydraulic chamber can be bilaterally delimited by narrow annular gaps opposite the inner chamber of the valve housing.

There is implemented an injector principle which obviates the need for an additional operating medium for the hydraulic bearing. The fuel fills via at least one annular gap the valve's hydraulic chamber which ensures length compensation.

The fuel-pressurized hydraulic chamber is advantageously of very rigid construction in order to be able to absorb very high compressive and tensile forces for short periods, as is required for rapid opening and closing of the valve. The injection valve can therefore close approximately 5-10 times as quickly as in the case of resetting by a return spring alone according to the prior art, while at the same time preventing the losses in the valve needle stroke caused by the disadvantageous extension of the valve needle because of a high restoring force acting through the return spring.

According to the invention, the fuel pressure induced forces acting on the valve needle can be selectively set. For example, a fuel pressure induced closing force could be set, thereby ensuring that the valve needle reliably closes the valve even if the return spring is broken.

By means of appropriate routing of the fuel ducts, the fuel flows past the drive unit and, for example, the multilayer actuator and cools the piezoceramics. A further advantage therefore consists in the improved temperature characteristics of the injector. Direct injection into the combustion chamber subjects the injector to high temperatures. Moreover, modern injection concepts provide for multiple injections. The trend is toward continuous injection rate forming. Concepts involving 5 injections per cycle are already under discussion. This would produce additional waste heat. Injector cooling is therefore advantageous, even if no temperature problem has yet arisen with injectors according to the prior art using silicone oil as operating medium for the hydraulic bearing.

Thermal expansion, aging and setting effects cause the absolute position of the piezoelectric unit as well as the position relative to the valve housing to vary. Typical values are as much as a few 10 μm, but always well below 100 μm. The hydraulic chamber must be implemented high enough to ensure that it can compensate all the variations in length to be expected during service life. On the other hand, the hydraulic chamber must be implemented with as little height as possible in order to be able to form an abutment that is as rigid as possible. A typical hydraulic chamber height of 200 to 500 μm is therefore selected.

In order to facilitate filling of the hydraulic chamber with fuel it is provided that the hydraulic chamber is connected via a cross duct to a fuel supply duct leading into the main chamber.

BRIEF DESCRIPTION OF THE DRAWINGS

An exemplary embodiment of the injection valve according to the invention will now be described.

DETAILED DESCRIPTION OF THE PREFERRED EMBODIMENTS

Figure 1:
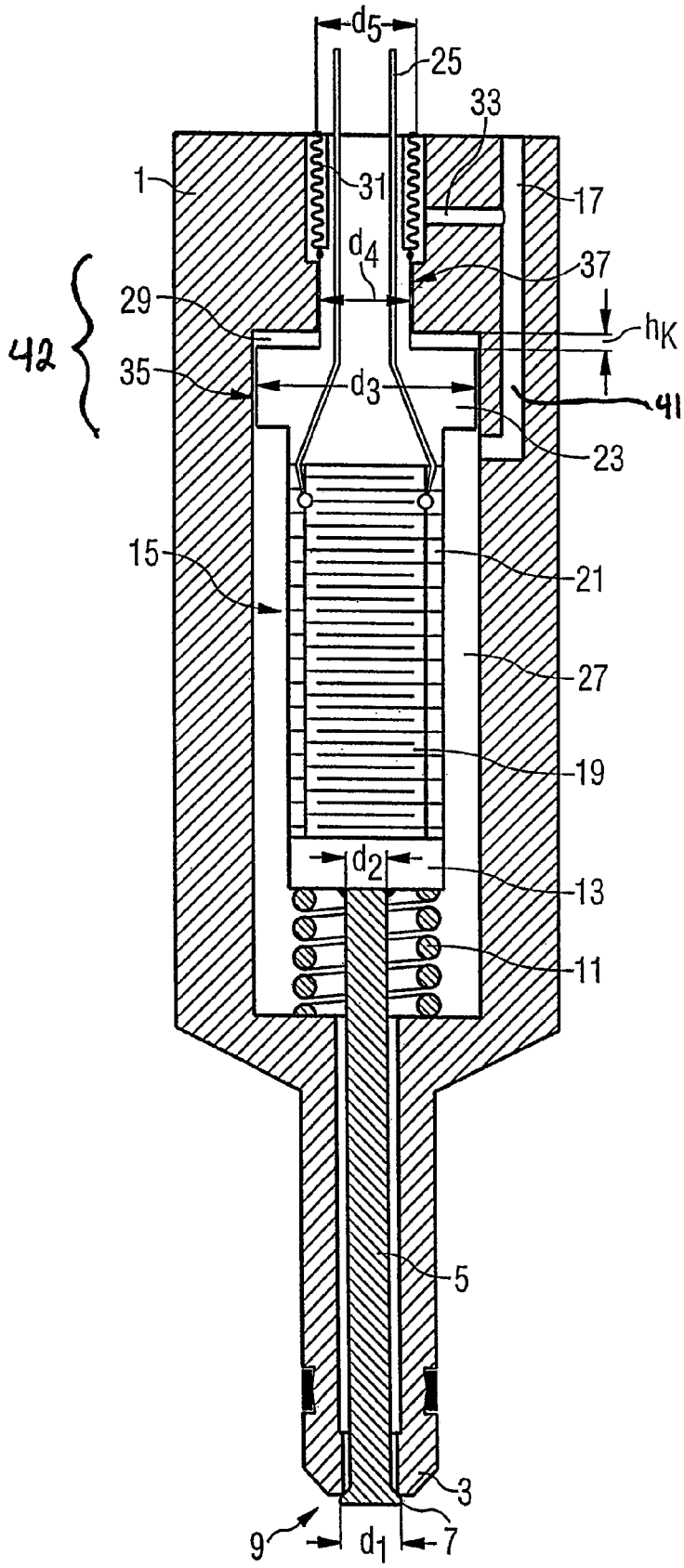
FIG. 1 shows the injection valve in simplified form in a schematic longitudinal cross-sectional view.

A high-pressure injector or the injection valve has a valve seat 3 in an injector housing 1. One diameter of the sealing line $d_1$ is typically 3-5 mm for a fuel-injection valve. In the basic state the valve seat 3 is held closed by means of a valve disk 7 connected to the lower end section of a valve needle 5 (diameter $d_2$), said valve needle 5 being disposed in a valve housing 1. The closed basic state of an injection nozzle 9 formed by the valve seat 3 and the valve disk 7 at the end of the housing 1 is ensured by a tensioned compression spring 11 with a typical spring force ($F_s$) of approximately 150 N. The compression spring is mounted between a base plate 13 of a drive unit 15 and a section of the inner wall of the valve housing 1. The valve needle 5 is rigidly connected, e.g. welded, to the base plate 13. The fuel is supplied to an inner chamber of the valve housing 1 through a duct bore 17 provided in the injector housing 1. In the upper section of the injector housing 1 there is disposed the drive unit 15. This is constituted by a piezoelectric multilayer actuator in low voltage technology (PMA) 19, a tubular spring 21, a hydraulic plunger 23 and the base plate 13. The tubular spring 21 is welded to the hydraulic plunger 23 and the base plate 13 so that the multilayer actuator 19 is under mechanical pre-compression. Electrical terminals 25 of the drive unit 15 are brought out upward from the housing 1, as described below. The inner chamber of the valve housing is separated by the hydraulic plunger 23 into a main chamber 27, accommodating in particular the PMA 19, and a hydraulic chamber 29. Above the hydraulic chamber 29, the drive unit 15 is connected to the injector housing 1 by means of a metal bellows 31 with a hydraulic or effectively pressurizing diameter $d_5$, thereby closing the inner chamber of the valve housing 1 to the environment. The inner chamber is additionally connected to the duct bore 17 in the vicinity of the metal bellows 31 via a cross duct 33.

In the basic state, with a fuel pressure $p_K$ of typically 100-300 bar applied, although very large pressure forces $F_D=p_K\cdot\pi\cdot(d_1^2-d_5^2)/4$ act on the base plate 13 and the hydraulic plunger 23, possibly producing a pressure force of $F_D$=1000-5000 N, this is cancelled out in the pressure balance if $d_1=d_5$ is selected. The pressure compensation does not need to be mathematically precise, but only accurate enough, as will now be described.

For typical injection valve dimensions, even a change in the fuel pressure from 100 to 300 bar at a 1 $mm^2$ deviation of the pressurized surfaces from the ideal compensation state results in an additional force ($F_D$) of approximately 20 N about which the closing force in the valve seat 3 varies. This force may counteract the spring force ($F_S$) of the compression spring 11 and, in the worst case scenario, unintentionally open the valve. On the other hand, this additional force ($F_D$) can also amplify the spring force ($F_S$) thereby making the valve more difficult to open. As the size of this unwanted additional force ($F_D$) increases, precise control of the injection process becomes more difficult. In particular, modern designs with multiple injection are then barely implementable any more. Preferably at least: $F_S>5\cdot F_D$, in particular $F_S>10\cdot F_D$.

The hydraulic plunger 21 is fitted into the correspondingly implemented injector housing 1 by means of a first and a second tight clearance fit 35,37 having a larger diameter $d_3$ and a smaller diameter $d_4$ and forms with the corresponding inner wall sections of the injector housing 1 the annular hydraulic chamber 29. When the injector is installed, the height of the hydraulic chamber $h_K$ is typically set to at least 100-500 μm. The hydraulic chamber 29 is used, for example, for compensating slow length variations (e.g. typical time durations t>1 s) of the drive unit 15 and/or of the valve needle 5 with respect to the injector housing 1 that are thermally induced or caused by aging effects of the PMA 19 in the injector. If these slow length variations occur, an unimpeded fluid exchange between the hydraulic chamber 29 and the surrounding fuel-filled inner chamber of the injector or of the main chamber 27 and the cross duct 33 can take place for length equalization via the narrow sealing gaps of the clearance fits 35,37 of the hydraulic plunger 23. These slow variations are therefore compensated by a variation in the height of the hydraulic chamber 29.

However, the sealing gaps between the hydraulic plunger 23 and the valve housing 1 must at the same time be narrow enough to ensure that, within typical injection times (0 ms<t<5 ms), no appreciable fluid exchange can occur between the hydraulic chamber 29 and the surrounding fuel-filled inner chamber of the injector, in particular the main chamber 27. The height of the hydraulic chamber $h_K$ must be able to vary by no more than about 1-2 μm due to leakage. In order to be able to open the valve and keep it open over a period 0 ms<t<5 ms during operation and then close it again, an average force of about 100-200 N is typically required depending on the magnitude of the spring force $F_S$. For a typical pressurizing surface $A_K=\pi\cdot(d_3^2-d_4^2)/4$ of approximately 240 $mm^2$ (assuming: $d_3$=18 mm, $d_4$=4 mm), the average pressure in the hydraulic chamber varies by $\Delta p=200\ N/A_K<10$ bar relative to the fuel pressure. The fluid flow through the maximally eccentrically disposed sealing gaps can be calculated by $$Q_L=2.5\cdot\pi\cdot(d_3+d_4)h^3\cdot\Delta p/(12\cdot\eta\cdot 1) \text{ with:}$$

Viscosity of gasoline: $\eta$=0.4 mPa·s;

Gap height: h=2 μm;

Length of sealing surfaces: 1=10 mm

Injection time: $t_E$=5 ms we get $Q_L$=28.8 $mm^3/s$; $\Delta V=Q_L\cdot 5\cdot 10^{-3}$ s=0.144 $mm^3$;

With $\Delta x=\Delta V/A_K$ we get $\Delta x$=0.6 μm as stroke loss because of the leakage flow during the injection time under the assumptions made above.

Because of the compressibility of gasoline, the hydraulic chamber 29 possesses a spring effect resulting in an additional loss in the valve stroke. The minimum spring rate of the hydraulic chamber 29 $c_K$ is calculated in accordance with $c_K=A_K/(\chi \cdot h_K)$ with $\chi=10^{-9}$ $m^2/N$ and $h_K=500$ μm to give $c_K=500$ N/μm and we therefore get:

$\Delta x=\Delta F/c_K=200$ N/500 N/μm=0.4 μm as the stroke loss of the valve because of the compressibility of gasoline.

This shows that the maximum stroke loss occurring, which is caused by the hydraulic chamber 29, is sufficiently small with suitable dimensioning. Altogether the drive unit 15 with the hydraulic plunger 23 and the valve needle 5 form a unit which can be displaced, as an entity, virtually unimpeded relative to the injector housing in the event of slow movements occurring compared to the injection process until the seating force ($F_D+F_s$) between the valve seat 3 and the valve disk 7 is set. The length of the annular gap is relatively uncritical here, the leaking flow decreasing with increasing length. As the leakage increases as the cube of the gap height h, the gap height must be selected sufficiently small. To summarize, therefore, slow variations in length, particularly of the PMA 19, are compensated by the hydraulic chamber 29 so that reproducible time responses of the valve needle stroke and therefore of the injection quantities can be controlled across all operating states and thermal loads. For the valves shown in FIGS. 1 and 2, the routing of the fuel in the injector housing is implemented in such a way that the functions of cooling the PMA 19 and of length compensation can be performed by means of the hydraulic chamber 29 using a single fluid.

The operation of the injection valve is now as follows: to start the injection process, the PMA 19 is charged via the electrical terminals 25. Because of the inverse piezoelectric effect, the PMA 19 expands (typical deflection: 30-60 μm), the PMA being supported on the rigid hydraulic chamber 29 in order to lift the valve disk 7 from the valve seat 3 against the spring force $F_S$ of the compression spring 11. The fuel can now emerge from the injection nozzle 9. The valve disk 7 is now subjected to the pressure of the injection chamber (not shown) on its lower surface facing away from the fuel, the hydraulic chamber 29 being implemented, as described above, as sufficiently rigid over a typical injection duration. To terminate the injection process, the PMA 19 is discharged again via the electrical terminals 25 and the PMA contracts. The hydraulic compressive stress (=hydraulic tensile force) and the spring resetting force of the compression spring 11 draw the valve disk 7 into the valve seat 3 and therefore close the valve. In the end position with the valve closed the hydraulic chamber 29 is maintained at a minimum height, the largest contribution to the resetting force coming from the hydraulic pre-compression. Because of its high rigidity and the high fuel pressures($p_K$=100-300 bar), the hydraulic chamber 29 is able to absorb even high tensile forces ($F_Z=p_K \cdot \pi \cdot (d_3^2-d_4^2)/4$ of $F_Z$=1000-5000 N) without appreciable variation in the hydraulic chamber height $h_k$.

Figure 2:
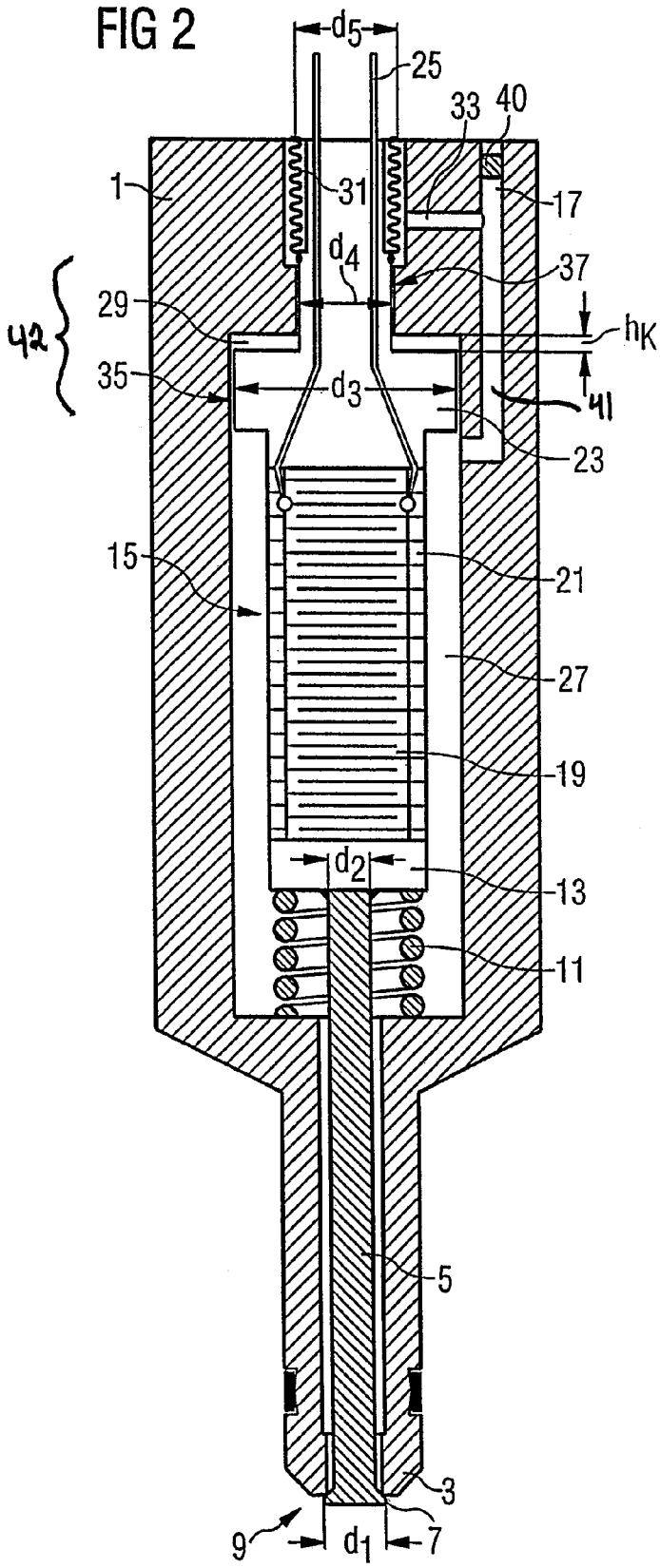
FIG. 2 shows the injection valve in simplified form in a schematic longitudinal cross-sectional view.

As shown in FIG. 2, by installing a check valve 40 in the high-pressure port 41 of the injector, high pressure can be maintained in the injector over a lengthy period while the fuel pump is switched off. The high-pressure port 41 may comprise one or both of fuel supply duct 17 and cross duct 33. When the engine is restarted, the injector volume itself is used as fuel pressure reservoir for the initial injection processes, until the injection pump injects the necessary fuel pressure into the injector.

Alternatively a magnetostrictive device can also be used as the drive for actuating the valve. With a suitably designed stroke reversal, the system described can also be used in principle for inward opening valves.

We claim:

1. An injection valve for fuel comprising:

a valve housing in which a drive unit controls the movement of a valve needle pretensioned by a spring, the drive unit having a first axial end proximate the valve needle and a second axial end remote from the valve needle, and an axial length between the first and second axial ends, the valve needle operable to close an opening of the injection valve with a valve closure member connected to a portion of the valve needle, an inner chamber in the valve housing, the inner chamber comprising a main chamber and a hydraulic chamber, a hydraulic bearing for the drive unit, wherein the hydraulic bearing includes the hydraulic chamber connected to the main chamber, wherein the hydraulic chamber is filled with high-pressure fuel as operating medium of the hydraulic bearing, and wherein the hydraulic bearing allows the second axial end of the drive unit remote from the valve needle to move axially relative to the valve housing in order to compensate for slow changes in the length of the drive unit, one or more electrical leads connected to the drive unit and extending through an opening at least partially defined by the housing; and a flexible seal configured to seal the one or more electrical leads in the opening, the flexible seal flexing in response to movement of the second axial end of the drive unit.

2. The injection valve according to claim 1, wherein the high-pressure fuel is used for cooling the drive unit.

3. The injection valve according to claim 1, wherein the axially acting pressure surfaces of the valve needle are dimensioned such that the resulting pressure forces essentially cancel each other out, causing the resulting axially acting force on the valve needle to be minimized compared to the force of the spring.

4. The injection valve according to claim 1, wherein a check valve is installed in a high-pressure port of the injection valve.

5. The injection valve according to claim 1, wherein the valve needle is fixed to the drive unit.

6. The injection valve according to claim 1, wherein the drive unit comprises a hydraulic plunger which in conjunction with the inner wall section of the valve housing forms the hydraulic chamber.

7. The injection valve according to claim 6, wherein a height of the hydraulic chamber is approximately 200 to 500 μm.

8. The injection valve according to claim 7, wherein the drive unit together with the hydraulic plunger and the valve needle form a fixed unit which can be displaced virtually unimpeded relative to the injector housing in the event of slower movements occurring compared to the injection process, taking the spring forces into account.

9. The injection valve according to claim 6, wherein the drive unit together with the hydraulic plunger and the valve needle form a fixed unit which can be displaced virtually unimpeded relative to the injector housing in the event of slower movements occurring compared to the injection process, taking the spring forces into account.

10. The injection valve according to claim 1, wherein the drive unit is connected to a hydraulic plunger which divides an inner chamber of the housing into the hydraulic chamber and the main chamber.

11. The injection valve according to claim 10, wherein the hydraulic chamber is connected via a cross duct to a high-pressure fuel supply duct entering the main chamber.

12. The injection valve according to claim 1, wherein the entire inner chamber of the valve housing between the flexible seal and an oppositely disposed valve seat is filled with the high-pressure fuel.

13. The injection valve according to claim 1, wherein the hydraulic chamber is bilaterally delimited by narrow annular gaps opposite an inner chamber of the valve housing.

14. An injection valve for fuel comprising:

a valve housing comprising an inner chamber comprising a main chamber and a hydraulic chamber;

a valve needle and a drive unit within said valve housing, the drive unit having a first axial end proximate the valve needle and a second axial end remote from the valve needle, and an axial length between the first and second axial ends;

the valve needle disposed in said main chamber and pretensioned by a spring controlled by said drive unit, the valve needle operable to close an opening of the injection valve with a valve closure member connected to a portion of the valve needle;

a hydraulic bearing for the drive unit, wherein the hydraulic bearing includes the hydraulic chamber connected to the main chamber, wherein the hydraulic chamber is filled with high-pressure fuel as operating medium of the hydraulic bearing, and wherein the hydraulic bearing allows the second axial end of the drive unit remote from the valve needle to move axially relative to the valve housing in order to compensate for slow changes in the length of the drive unit, one or more electrical leads connected to the drive unit and extending through an opening at least partially defined by the housing; and a flexible seal configured to seal the one or more electrical leads in the opening, the flexible seal flexing in response to movement of the second axial end of the drive unit.

15. The injection valve according to claim 14, wherein the axially acting pressure surfaces of the valve needle are dimensioned such that the resulting pressure forces essentially cancel each other out, causing the resulting axially acting force on the valve needle to be minimized compared to the force of the spring.

16. The injection valve according to claim 14, wherein the drive unit has a hydraulic plunger which in conjunction with the inner wall section of the valve housing forms the hydraulic chamber.

17. The injection valve according to claim 16, wherein the drive unit together with the hydraulic plunger and the valve needle form a fixed unit which can be displaced virtually unimpeded relative to the injector housing in the event of slower movements occurring compared to the injection process, taking the spring forces into account.

18. The injection valve according to claim 14, wherein the entire inner chamber of the valve housing between the flexible seal and an oppositely disposed valve seat is filled with the high-pressure fuel.

19. An injection valve for fuel comprising:

a valve housing in which a drive unit controls the movement of a valve needle pretensioned by a spring, the drive unit having a first axial end proximate the valve needle and a second axial end remote from the valve needle, and an axial length between the first and second axial ends, the valve needle operable to close an opening of the injection valve with a valve closure member connected to a portion of the valve needle;

an inner chamber in the valve housing, the inner chamber comprising a main chamber and a hydraulic chamber, wherein the main chamber is in the valve housing and is filled with fuel at a high pressure;

a hydraulic bearing for the drive unit, wherein the hydraulic bearing includes the hydraulic chamber connected to the main chamber, wherein the hydraulic chamber is filled with the high-pressure fuel as operating medium of the hydraulic bearing, and wherein the hydraulic bearing allows the second axial end of the drive unit remote from the valve needle to move axially relative to the valve housing in order to compensate for slow changes in the length of the drive unit;

one or more electrical leads of the drive unit extending in an opening between the drive unit and the housing; and a flexible seal of the opening around the electrical leads, wherein the entire inner chamber of the valve housing between the flexible seal and an oppositely disposed valve is filled with the high-pressure fuel, wherein said flexible seal flexes in response to movement of the second axial end of the drive unit.

* * * * *